US005582052A

United States Patent [19]

Rigsby

[11] Patent Number: 5,582,052

[45] **Date of Patent: *Dec. 10, 1996**

[54] CONTROLLED TIME-OVERLAPPED HYDROFORMING

[75] Inventor: Donald R. Rigsby, Jenison, Mich.

[73] Assignee: Benteler Industries, Inc., Grand Rapids, Mich.

[ * ] Notice: The term of this patent shall not extend beyond the expiration date of Pat. No. 5,363,544.

[21] Appl. No.: 241,740

[22] Filed: May 12, 1994

Related U.S. Application Data

[63] Continuation-in-part of Ser. No. 65,126, May 20, 1993, Pat. No. 5,363,544.

[51] Int. Cl.[6] ..... B21D 39/08

[52] U.S. Cl. ..... 72/62; 72/369; 29/33 T; 29/421.1

[58] Field of Search ..... 72/58, 61, 62, 72/368, 369, 367; 29/523, 455.1, 421.1, 33 T

[56] References Cited

U.S. PATENT DOCUMENTS

| | | | |
|---|---|---|---|
| 1,879,009 | 9/1932 | Anthony | 72/62 |
| 2,138,268 | 11/1938 | Dake | 113/43 |
| 2,667,136 | 1/1954 | Reichl | 72/62 |
| 3,266,086 | 8/1966 | Markevitch | 18/4 |
| 3,663,027 | 5/1972 | Klipping | 279/4 |
| 3,691,266 | 9/1972 | Greenberg | 264/86 |
| 3,833,330 | 9/1974 | Aoki | 425/247 |
| 3,947,196 | 3/1976 | Tribbett | 425/248 |
| 4,210,467 | 7/1980 | Klatzer | 148/12 |
| 4,319,471 | 3/1982 | Benteler | 72/59 |
| 4,519,230 | 5/1985 | Chachin | 72/56 |
| 4,636,608 | 1/1987 | Palentyn | 219/121 |
| 4,644,128 | 2/1987 | Palentyn | 219/121 |
| 4,708,390 | 11/1987 | Palentyn | 296/188 |
| 4,798,076 | 1/1989 | Rigsby | 72/352 |
| 5,107,693 | 4/1992 | Olszewski | 72/58 |
| 5,118,159 | 6/1992 | Horling | 296/188 |
| 5,123,694 | 6/1992 | DePierre | 296/188 |
| 5,170,557 | 12/1992 | Rigsby | 29/890 |
| 5,363,544 | 11/1994 | Wells et al. | 72/62 |

FOREIGN PATENT DOCUMENTS

| | | | |
|---|---|---|---|
| 1343405 | 1/1974 | England | 425/451.9 |
| 0494843 | 7/1992 | European Pat. Off. . | |
| 2027934 | 12/1971 | Germany | 425/451.9 |
| 6500281 | 7/1965 | Netherlands | 320/25 |

*Primary Examiner*—David Jones
*Attorney, Agent, or Firm*—Price, Heneveld, Cooper, DeWitt & Litton

[57] ABSTRACT

Apparatus and method for hydroforming a dual wall conduit having a controlled size gap between the walls, a frame having an upper crown and a lower bed defining a hydroforming space therebetween, the bed having a slideway extending from the space to a load-unload-preform position out of the space. A mold assembly on the slideway has a lower platen and an upper platen defining at least two hydroforming cavities, one cavity being an elongated preform and semi-finish cavity, and the other cavity being an elongated finish cavity. Mold shifting means is positioned for shifting the mold assembly on the slideway from the position in the space between the crown and bed, to and from the forward load-unload-preform position. Mold closing and preforming hydraulic cylinders are operably connected to the upper mold platen for closing the upper platen onto the lower platen and creating mechanical preforming on dual wall tubular stock in the preform and semi-finish form cavity. The upper crown has a peripherally retained bladder over the mold assembly for applying a closure clamping force on the mold assembly by the bladder. A first pair of double acting, tube sealing, hydroforming elements are at the ends of the preform, semi-finish cavity, and a second pair of tube sealing hydroforming elements are at the ends of the finish cavity.

10 Claims, 12 Drawing Sheets

CONTROLLED TIME-OVERLAPPED HYDROFORMING

RELATED APPLICATION

This is a continuation-in-part application of application Ser. No. 08/065,126, filed May 20, 1993, and entitled MULTI-STAGE DUAL WALL HYDROFORMING, now U.S. Pat. No. 5,363,544.

BACKGROUND OF THE INVENTION

This invention relates to hydroforming of dual wall conduit elements, and particularly to a hydroforming method and apparatus for forming dual wall, air gap conduit elements, particularly for engine exhaust system components.

Hydroforming of conduits such as engine exhaust components is known, as set forth for example in U.S. Pat. No. 5,170,557. Such components with dual walls separated as by an air gap have proven to be particularly effective in increasing efficiency of downstream exhaust catalytic converters etc., as well as controlling noise. Application Ser. No. 065,126 sets forth a hydroforming method and apparatus for creating such components in successive cavities of a mold.

SUMMARY OF THE INVENTION

An object of this invention is to provide a further development of the subject matter in the above application, to enable high speed production hydroforming, as well as optional mechanical preforming of dual wall conduit components. The hydroforming apparatus has a pair of hingedly interconnected mold platens which support mold elements that define a pair of successive forming cavities therein. The mold assembly is supported on a bed which includes a slideway allowing the mold assembly to be shifted between an outer, load-unload-preform position on the bed, and an inner position between the upper crown and the bed. The tipper crown has a pressure responsive bladder for pressing the platens together with tremendous force. Fluid cylinders not only open and close the mold, but also mechanically preform the dual wall workpiece blank with configuration complexities, e.g., indentations, patterns and the like, as required. Such preforming is in addition to the subsequent hydroforming sequence, and using the same mold assembly.

In the embodiment depicted, the mold is closed, any preforming is performed, and the mold is initially held closed by a pair of fluid cylinders extending between the frame and the open platen. During the shift of the mold into the space between the crown and bed, the mold closing cylinders are caused to shorten by controlled bleed-off of a hydraulic fluid through a programmed relief valve, while still maintaining required pressure on the mold. Alternatively, these cylinders may be attached to the slide on the moving platen. When so installed, the programming for retraction is simpler while it functions much the same as related to preforming. A bladder is positioned over the mold assembly to apply force of amounts equivalent to the force resulting from pressure required to hydroform the component, i.e., of sufficient magnitude to resist the mold separating force that occurs during hydroforming pressurization of the workpiece. When the mold assembly is between the upper crown and the lower bed, pressure is applied to the bladder to retain the mold closed even when the tremendous hydroforming forces are applied. During the hydroforming steps, with the mold held closed, hydroforming pressure increases in one cavity, then as it is being decreased, it is increased in the other cavity, such that the hydroforming times are overlapped.

The novel hydroforming apparatus enables hydroforming force loads of hundreds of tons, e.g., at a fraction of the cost of a conventional press which would be capable of handling comparable loads. The equipment is designed in such a way as to be easily sized up or down to handle a variety of tonnages, e.g., 500, 1,000, 1,500 tons and up. In the case of forming automotive exhaust ducts, the preferred holding force is about 1,000 tons. Moreover, the hydroforming process can be accomplished in a small fraction of the time required in presently known hydroforming equipment.

These and other objects, advantages and features of the invention will become apparent upon studying the following specification in conjunction with the drawings.

DESCRIPTION OF THE PREFERRED. EMBODIMENT

Figure 1:
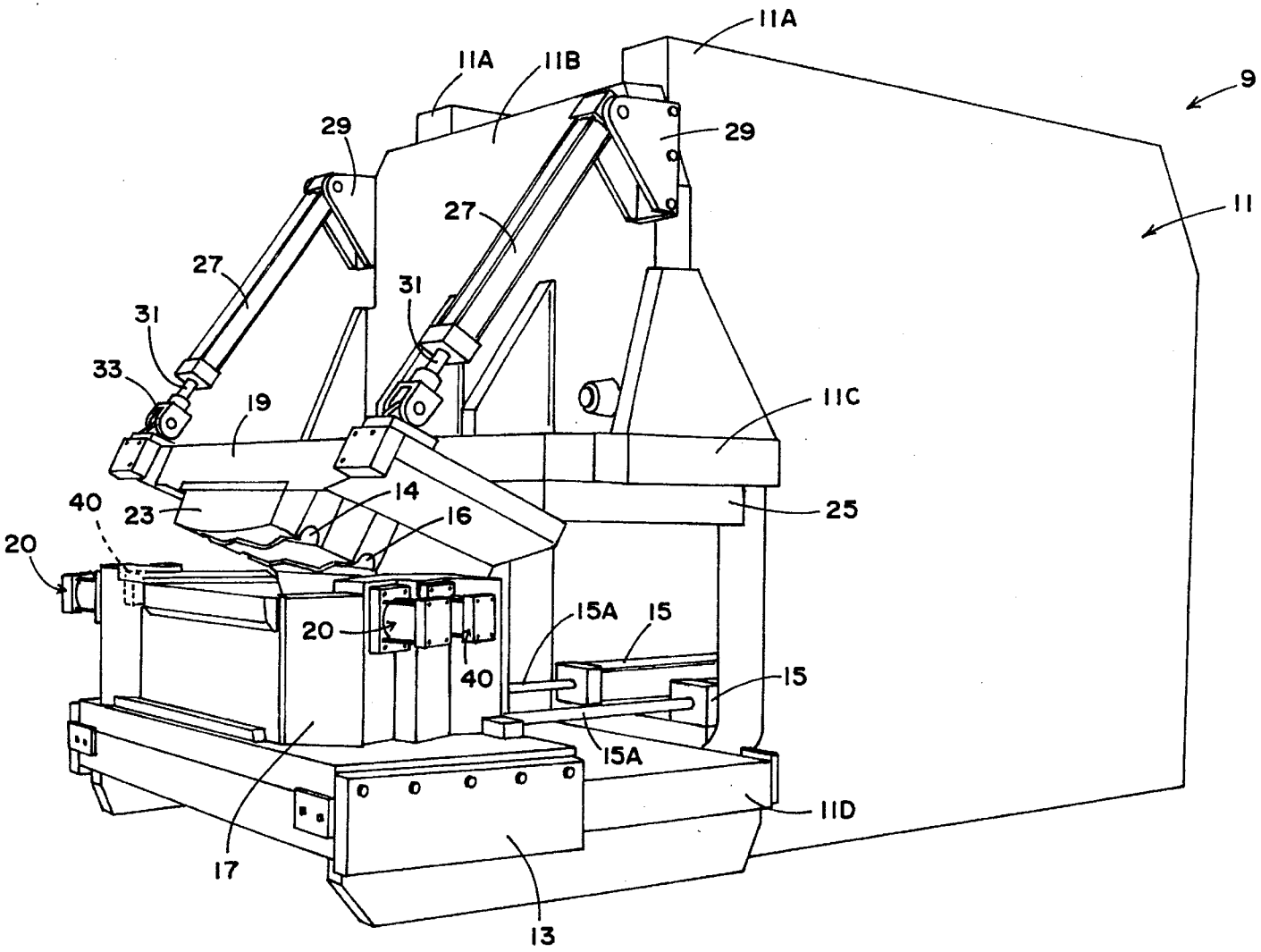
FIG. 1 is a perspective view of the apparatus of this invention.
Figure 2:
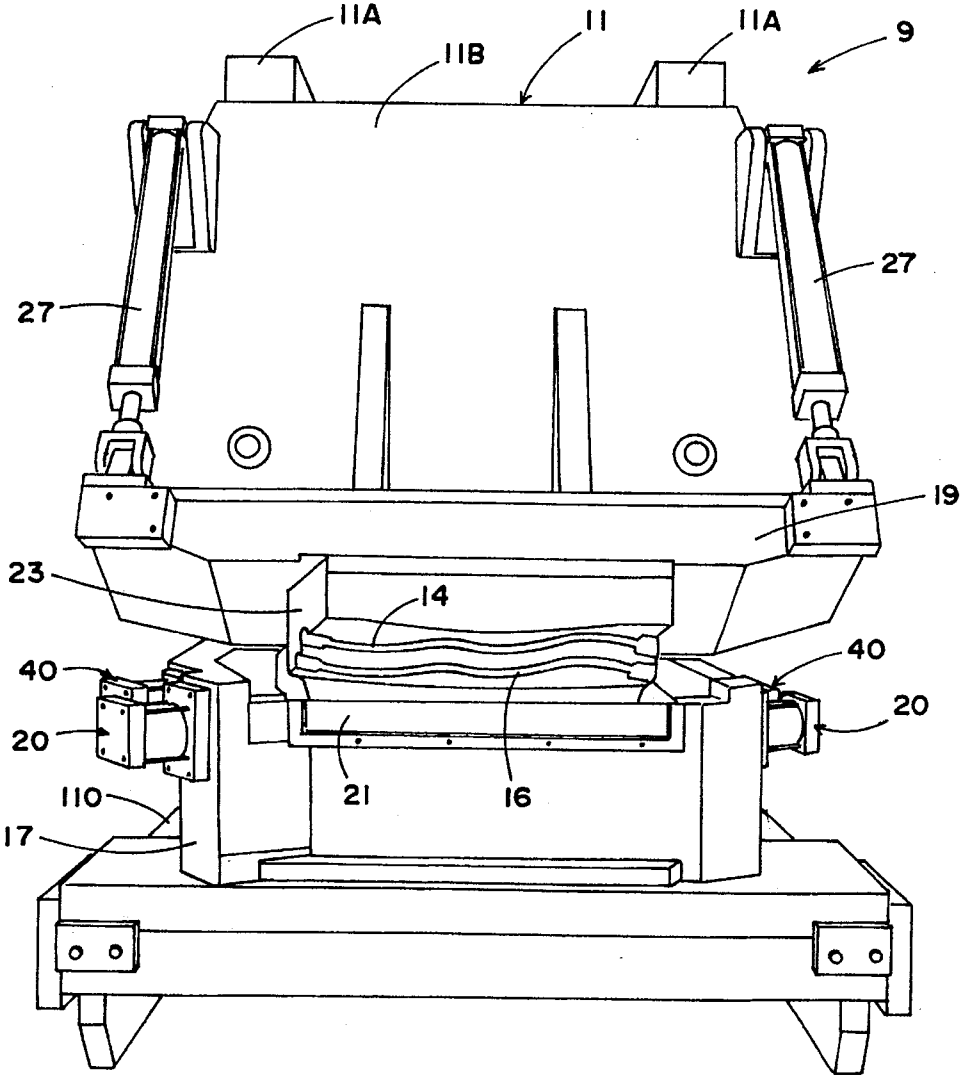
FIG. 2 is a front perspective view of the apparatus in FIG. 1.
Figures 6A, 6B, 6C, 6D:
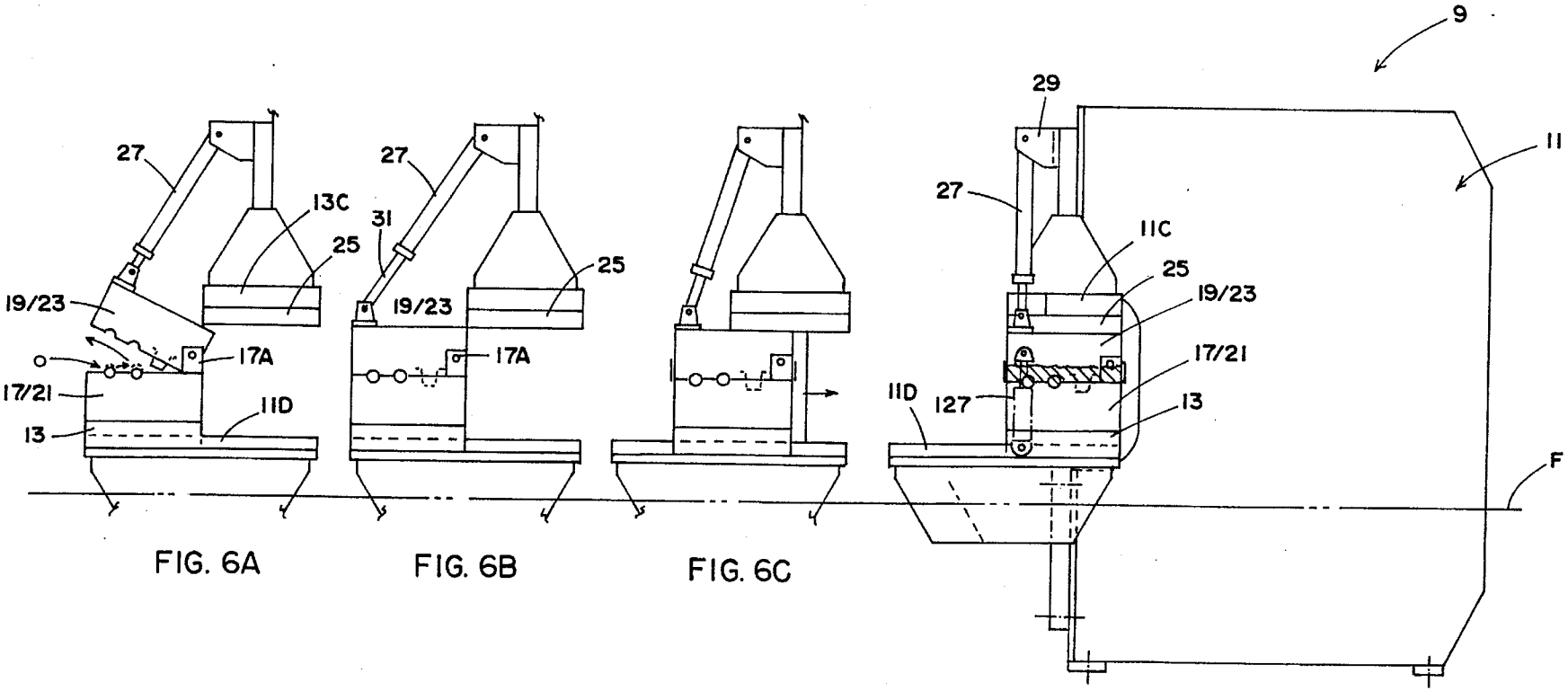
FIG. 6A is a side elevational schematic view of the load and unload aspects of the invention.
FIG. 6B is a side elevational schematic view of the mold closing and preforming step.
FIG. 6C is a side elevational schematic view of the mold and platen assembly being transferred into the hydroforming position.
FIG. 6D is a side elevational schematic view of the assembly during the hydroforming step.

Referring now to the complete assembly in FIGS. 1 and 2, this assembly 9 comprises a frame 11 which includes a pair of parallel spaced, thick steel, generally C-shaped plates 11A interconnected by cross plates including vertical cross plate 11B at the front of the apparatus and horizontal cross plate 11C. Lower portions of the C-shaped plates extend below the floor level F and are not shown in FIGS. 1 and 2, but can be seen in FIG. 6D. Plate 11C in effect forms the crown of the press clamp, as will be understood from the description to follow. The lower portion of frame 11 also has a horizontal member 11D which forms the bed of the press. Between crown 11C and bed 11D is a space for the platen and mold subassembly, as will be described. Bed 11D has a lubricous stirface as of polymeric material such as that known by the brand name Turkitc™. This bed 11D extends forwardly of the assembly well beyond crown 11C, being about twice the length of the crown so that the platen and mold subassembly can be moved back and forth between a load-unload and preform position forwardly out of the space between the bed and crown, as shown in FIGS. 1 and 2, and a second position within the space, i.e., below crown 11C and above bed 11D, for the hydroforming semi-finish and finish operations to be described. The platen and mold subassembly is shown to include a carriage 13 movable on bed 11D with contraction and extension of either a pair of large fluid cylinders 15, or alternatively, one such cylinder located generally central to the movable bed, and between plates 11A and 11B of frame 11. The piston rods 15A of the cylinder is attached to carriage 13, while the cylinder itself is anchored relative to frame 11. Mounted on carriage 13 is a lower platen 17. An upper platen 19 is hingedly attached to the lower platen along its rear edge so as to pivot between the raised open position toward the front as depicted in FIGS. 1, 2 and 6A and the lowered closed position depicted in FIGS. 6B, 6C and 6D. Mounted on the lower platen 17 is a lower mold element 21. Mounted on the upper platen 19 is an tipper mold element 23. These two mold elements each define a pair of spaced hydroforming cavities, one cavity being the semi-finish cavity 14, e.g., the front one, and the other being the finish cavity 16.

Suspended beneath horizontal crown 11C is a force bladder subassembly 25. When upper platen 19 and upper mold element 23 are lowered to the closed position, there is only a small clearance of about 0.040 inch between the lower surface of bladder subassembly 25 and the upper surface of platen 19.

Mounted on lower platen 17, at the axial ends of each mold cavity, is a pair of end plug hydroforming subassemblies, i.e., one pair for the semi-finish cavity and one pair for the finish cavity. These end plug subassemblies include fluid cylinder actuators, there being a single cylinder for each end of the finish cavity and there being a double cylinder for each end of the semi-finish cavity, as will be explained more fully hereinafter.

Connected between the frame 11 and the front of platen 19, i.e., opposite the rear hinge 17A, is a pair of diagonally oriented fluid actuators 27 which constitute fluid cylinders having one end thereof mounted to brackets 29 on the upper part of frame 11, and having the ends of their extended piston rods 31 connected by brackets 33 to platen 19. These are two-way cylinders which can lift and elevate the heavy upper platen 19 and mold 23 to open the mold subassembly, or can lower and close the upper platen and mold and also apply a mechanical preforming force on dual wall workpieces placed within the preform, semi-finish form cavity.

Figure 3:
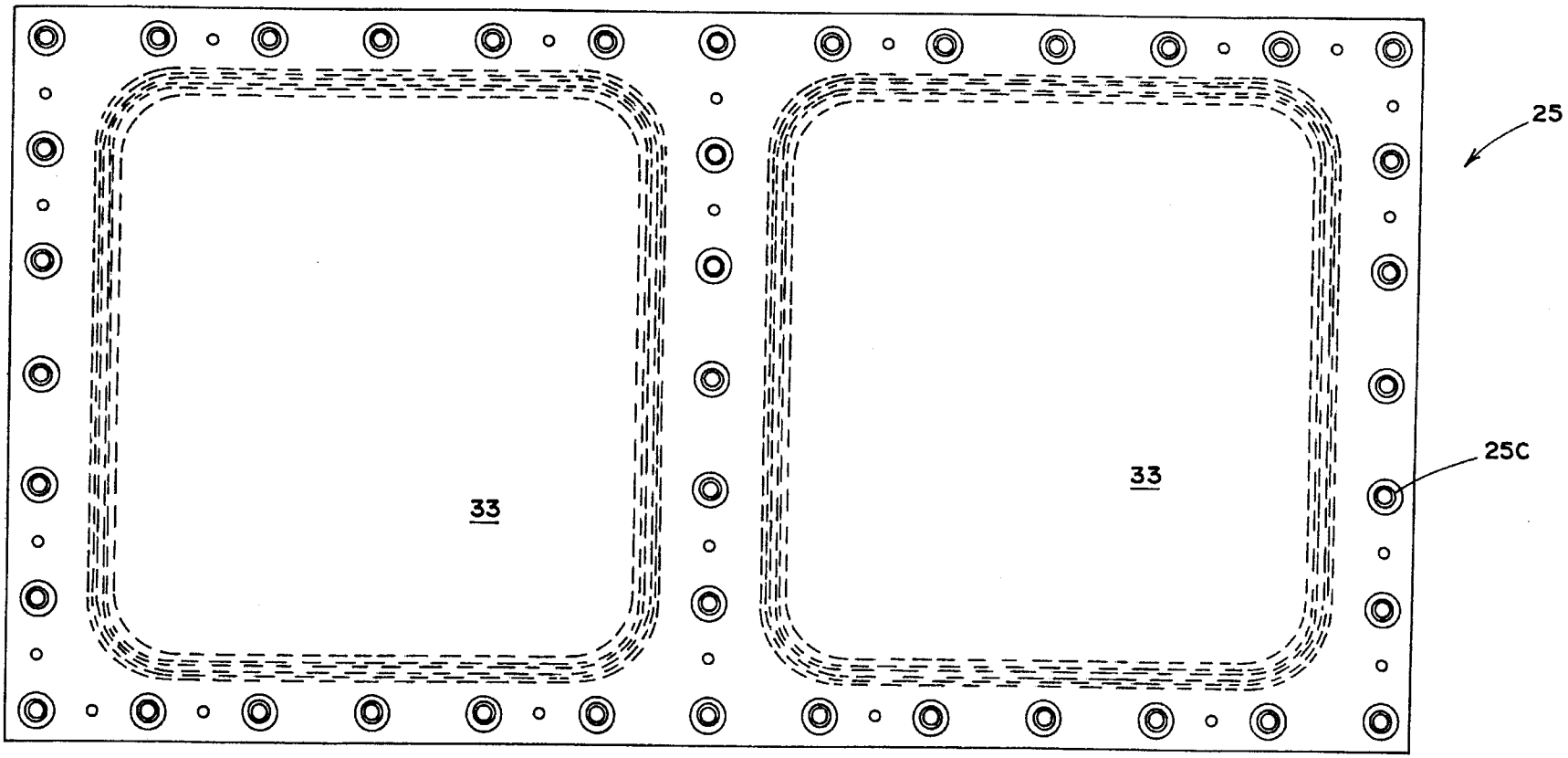
FIG. 3 is a plan view of the bladder subassembly in the upper platen.
Figure 4:
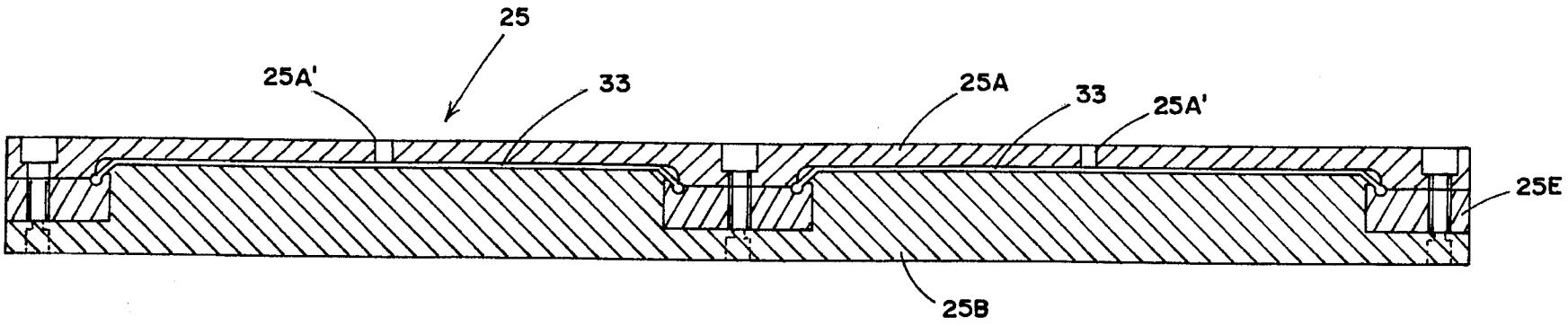
FIG. 4 is a sectional elevational view of the subassembly in FIG. 3.
Figure 8:
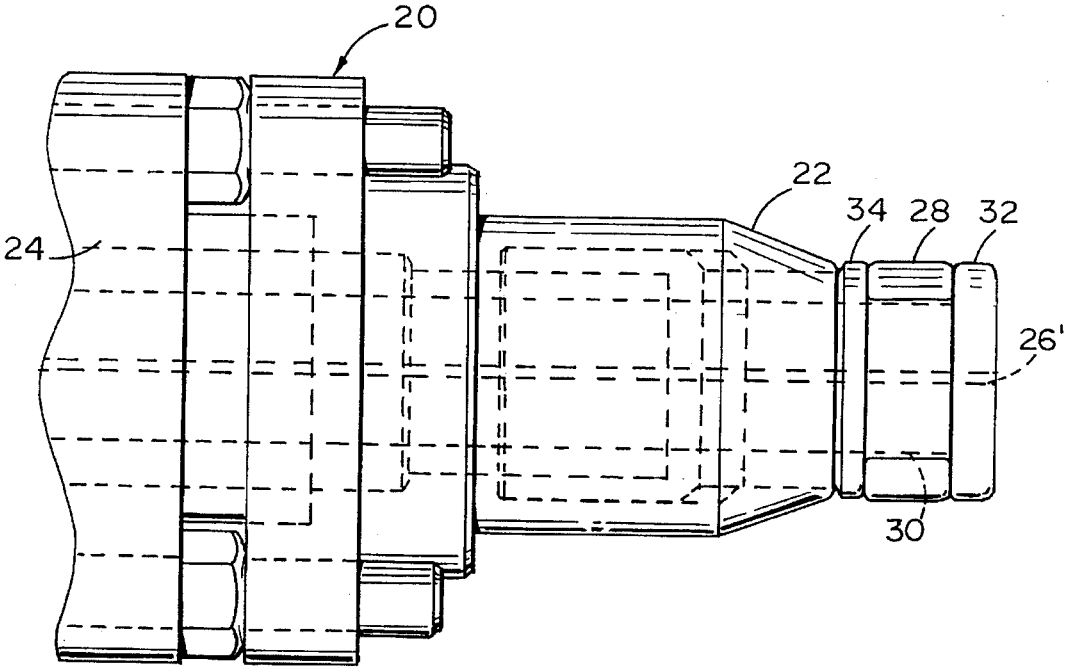
FIG. 8 is an enlarged elevational view of one of the first pair of end plug subassemblies.
Figure 10:
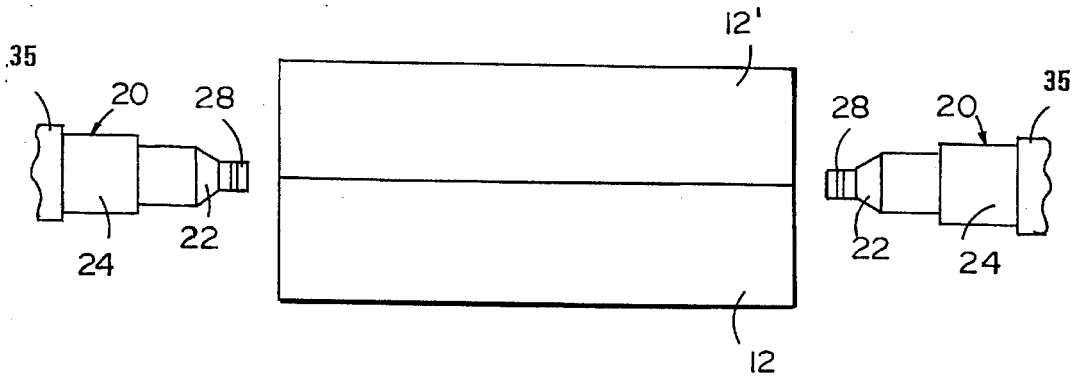
FIG. 10 is a diagrammatic elevational view of the hydroforming mold subassembly and end plug subassemblies.

The clamping force bladder subassembly 25 is shown in more detail in FIGS. 3 and 4. This includes a pair of upper and lower cooperative retainers 25A and 25B which have limited vertical movement of approximately 0.070 inch relative to each other. Upper retainer 25A is affixed to crown 11C and suspends lower retainer 25B therebeneath. The two are affixed together with a series of bolts 25C around the periphery and across the middle thereof, there being a compression spring at each one of these bolts to bias the lower retainer 25B up against the upper retainer 25A. In the preferred embodiment, there is an intermediate retainer plate 25E, generally resembling the FIG. 8, and bolted tightly to upper retainer 25A. A pair of rubber diaphragms 25E have a peripheral bead therearound, this bead being clamped between element 25E and tipper retainer 25A. Fluid inlet ports (not shown) are provided through upper retainer 25A to the upper surface of diaphragms 33. By injecting a highly pressurized fluid through conduits and the fluid inlet ports 25A' to the upper surface of these diaphragms 33, they force the lower retainer 25B downwardly the maximum of about 0.125 inch and normally only slightly more than 0.040 inch, i.e., the clearance between the lower surface of subassembly 25 and the upper surface of platen 19. By applying high pressures to the diaphragms, a tremendous force can be applied to the mold assembly to keep it closed when hydroforming the metal conduits. Because the peripheral edges of the diaphragms are slanted downwardly from the main planar body of the diaphragms, the applied pressure does not cause them to stretch but rather to move to a more relaxed tension condition even though the pressure across the thickness of the diaphragms is substantial.

In FIGS. 6A–6D are shown the sequential movements of the apparatus in practicing the hydroforming process. FIG. 6D shows the assembly 9 with frame 11, bed 11D, carriage 13, lower platen and mold 17/21, upper platen and mold 19/23, crown 11C, bladder subassembly 25, cylinders 27 and brackets 29. For convenience, FIGS. 6A, 6B and 6C show the assembly minus portions of frame 11.

Figure 11:
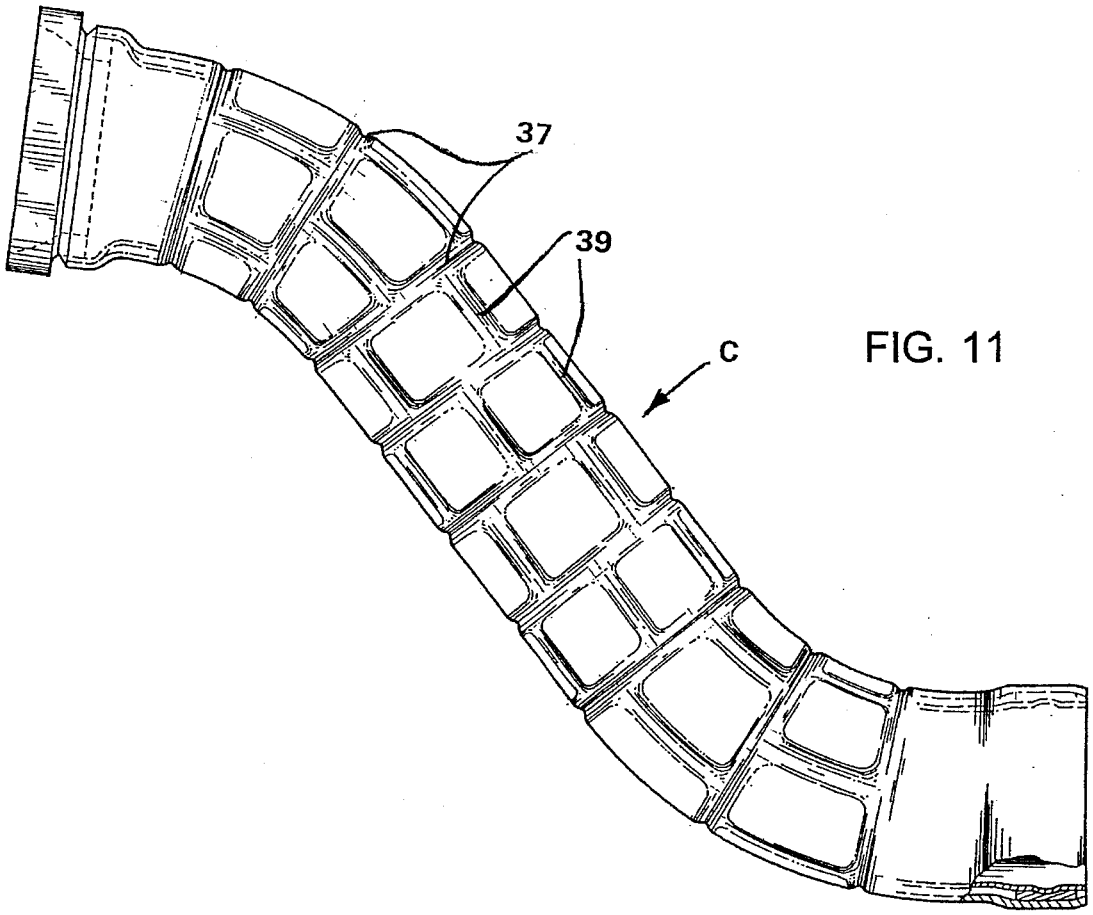
FIG. 11 is an elevational view of an exemplary conduit surface pattern.

In FIG. 6A, the carriage 13 and the mold assembly are in a position removed from the space between crown 11C and bed 11D, with the upper mold and platen 19/23 being lifted by cylinders 27 up away from lower platen mold 17/21 on hinge 17A. In this open condition, a finished workpiece is removed from the finish cavity, a semi-finished workpiece is moved to the finish cavity from the semi-finish cavity, and a raw or blank workpiece is inserted into the semi-finish cavity, each of these movements being shown by arrows. In FIG. 6B, cylinders 27 are shown actuated to extend the piston rods 31 thereof, closing the mold assembly by lowering the upper platen and mold 19/23 down with sufficient force to apply any desired preform mechanical deformation of the raw or blank workpiece in the preform-semi-finish cavity. For example, certain exhaust conduit components require specific indentations to be placed into the periphery thereof. More complex indentation patterns can be applied to the periphery of the conduit C, as depicted in FIG. 11, by annular indentations and axial indentions forming what is there shown as a brick-type pattern. Other pattern variations can be applied, as shown for example in copending application Ser. No. 136,415, filed Oct. 13, 1993, and entitled Patterned Air Gap Engine Exhaust Conduit, and incorporated herein by reference. These can be partially applied during the preforming step to the extent that it is desired to indent both the inner and outer tubes. The final pattern can be applied to the outer tube alone in the final hydroforming step to be described. After this closure and preforming step, the carriage with the closed mold assembly is drawn into the space between crown 11C and bed 11D, and specifically below bladder clamp subassembly 25. As noted previously, the clearance between the upper surface of the platen 19 and the lower surface of bladder subassembly 25 is only about 0.040 inch. Inasmuch as the depicted cylinders 27 are connected between the mold assembly and frame 11, the piston rods must be allowed to contract into the cylinders as this mold assembly is moved into this space, since the vertical distance between the brackets 29 and the mold assembly lessens. This contraction is achieved by having a controlled pressure release valve connected in the fluid line to the cylinders, so that the cylinders can be partially contracted while pressure will be maintained in a controlled amount on the mold assembly.

Once the mold assembly is in proper position beneath the bladder clamp subassembly 25, pressurized fluid is introduced above the surfaces of bladders 33, forcing lower retainer 25B down against the upper platen to press the mold assembly together with a force slightly exceeding the force created through hydroforming. This is to keep the mold closed through the hydroforming process. Preferably, the lower mold is located in a water bath so that as the workpieces are placed in the lower mold they become filled with water which is subsequently placed under tremendous pressure to accomplish the hydroforming operations. Preferably the pressure is first applied to the preformed product in the semi-finish cavity 14 to enlarge both walls of the double wall workpiece to the size of the semi-finish cavity, and as the pressure in this semi-finished workpiece then diminishes in this cavity, the pressure is increased in the workpiece within the finish cavity 16 to expand only the exterior wall to the finish cavity dimensions and configuration, as explained more fully hereinafter.

The mold assembly 10 depicted includes the lower mold element 21 which is optionally a mirror image of the upper one 23. These define the first semi-finish mold cavity 14 and a second finish toolet cavity 16. The diametral and circumferential dimensions of the first cavity are smaller than those of the second cavity, and are sized to provide a desired final dimension for the inner tubular member of the workpiece by limiting expansion of the outer tubular member. The diametral and circumferential dimensions of the second cavity are sized to the desired final dimension of the outer tubular member of the pair of tubular members forming the workpiece. Cavity 16 has a configuration from end to end matching that of the desired final conduit, especially a vehicle engine exhaust conduit, configured to match the requirements of a particular vehicle and shown, for example, to have bend zones between the opposite ends thereof. The bend zones in these two forming cavities 14 and 16 correlate with each other positionally. These bend zones can be formed by well known conventional methods not shown here. Previously bent exhaust pipe conduit workpieces W are sequentially placed in cavity 14, mechanically preformed by forced mold closure, hydroformed in that cavity, and then placed in cavity 16 and hydroformed further to the finish state.

At the opposite ends of the first cavity 14 is a first pair of special end plug subassemblies 20. Each of these is shown in more detail in enlarged fashion in FIG. 8. Each includes a frustoconical, tapered nose 22 oriented toward the mold cavity, and having a diameter which varies from the smallest diameter outer end portion, smaller in diameter than the diameter of cavity 14 and the inside diameter of the inner tube, to the largest diameter portion which is larger than the diameter of cavity 14. Each tapered nose is shiftable axially on the central axis of subassembly 20 for extension and retraction, by a first power actuator 24, preferably a fluid cylinder, with nose 22 being attached to the piston rod of the cylinder. Tapered nose 22 on the two end plugs is for the purpose of flaring the ends of the conduit workpiece W inserted in cavity 14, and holding the workpiece on center in the cavity. End plug subassembly 20 also includes a radially expandable annular, deformable, resilient seal 28 mounted around a central rod 30 which has an enlarged flange-type collar 32 on its outer end and against the axial outer end of seal 28. The other axial inner end of seal 28 abuts against collar 34 adjacent the outer end of tapered nose 22. This entire assembly can be axially advanced by fluid cylinder 35 into the cavity and workpiece, or retracted therefrom. The other fluid cylinder 24 has a short stroke to shift collar 34 axially outwardly to compress and axially squeeze resilient seal member 28, causing it to radially expand and thereby seal the ends of the workpiece. The at-rest smaller diameter of seal 28 is purposely made smaller than the interior diameter of workpiece W, while the expanded diameter is equal to, or even slightly greater when unrestrained, than the inner diameter of the workpiece, to form a fluid tight seal therein and against rod 30 for purposes to be explained hereinafter. These annular seals extend sufficiently into the workpiece to seal off openings 54 from the inner ends of the end plugs.

Extending through end plug subassemblies 20 to communicate with a workpiece in cavity 14 is a liquid conducting passage 26 for entry and exit of hydroforming fluid such as water, as explained more fully hereinafter.

Figure 7:
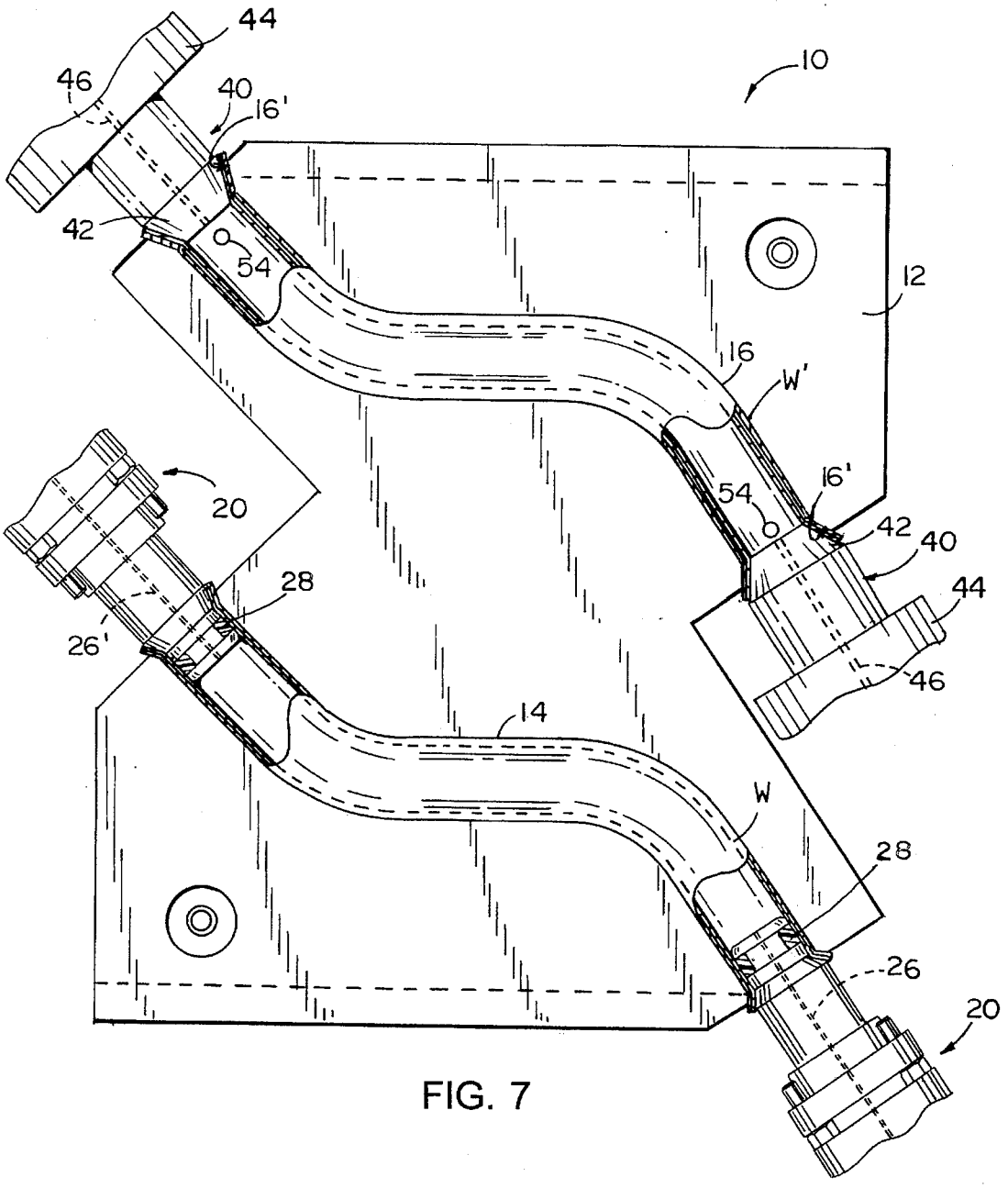
FIG. 7 is a plan view of the hydroforming mold arrangement, showing first and second die cavities and first and second pairs of end plug subassemblies.
Figure 9:
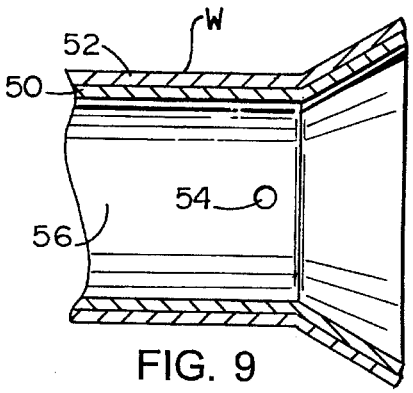
FIG. 9 is a fragmentary sectional view of an end portion of the workpiece after the ends are flared.

The second pair of end plug subassemblies 40 (FIG. 7) for second cavity 16 are also characterized by having a tapered, frustoconical nose 42, the smaller end diameter of which is oriented toward cavity 16, and is smaller in diameter than this second cavity 16, while the larger diameter portion is larger in diameter than the diameter of cavity 16. A fluid cylinder power actuator 44 axially shifts the end plug with its tapered nose toward and away from cavity 16.

In the second pair of end plugs 40, at least one has a liquid conducting passage 46 therethrough into the modified workpiece W' in cavity 16 for filling and pressurizing hydroforming liquid, normally water, in this workpiece, in a manner to be described more fully hereinafter.

Figure 5A:
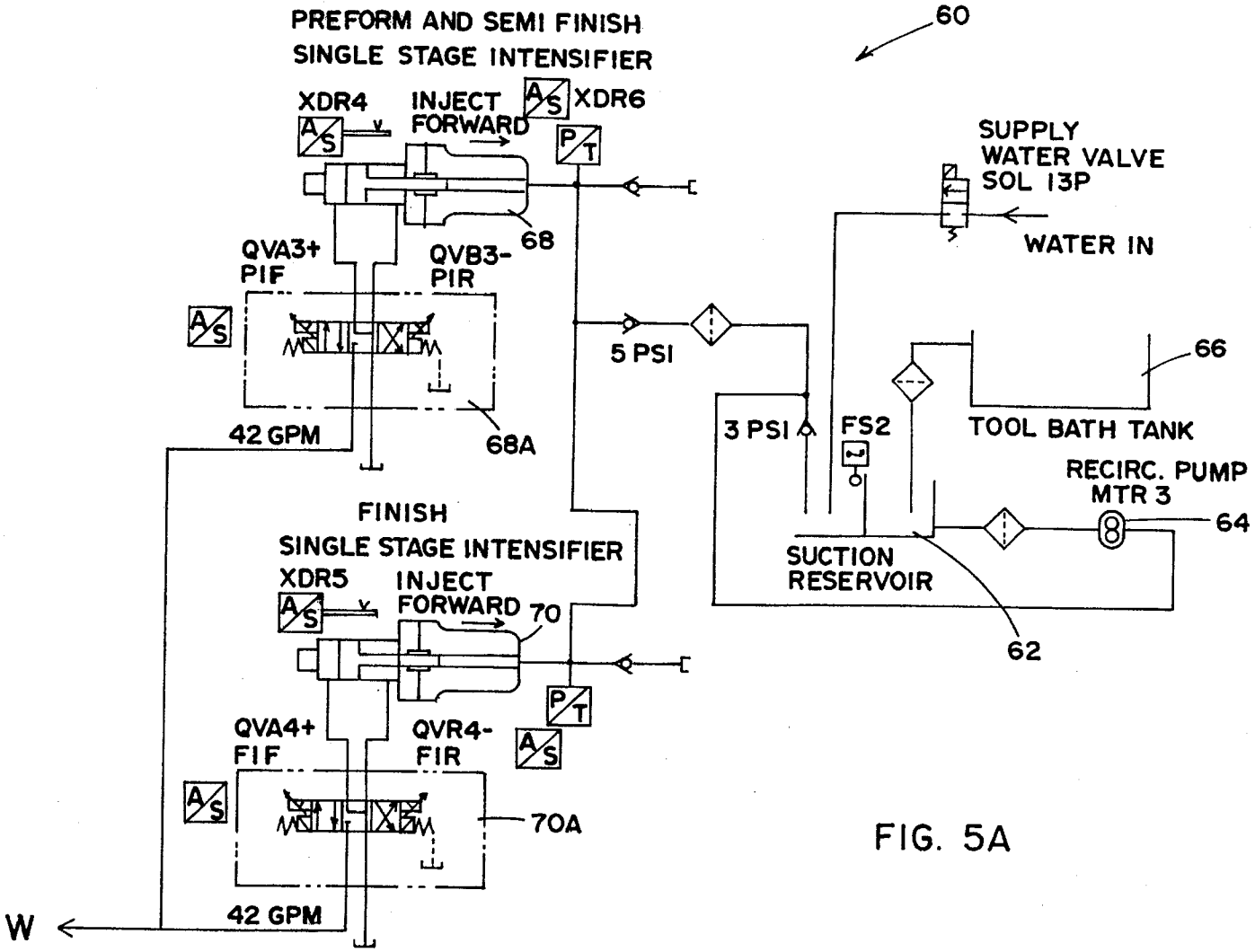
FIGS. 5A and 5B is a schematic view of part of the hydraulic system.
Figure 5B:
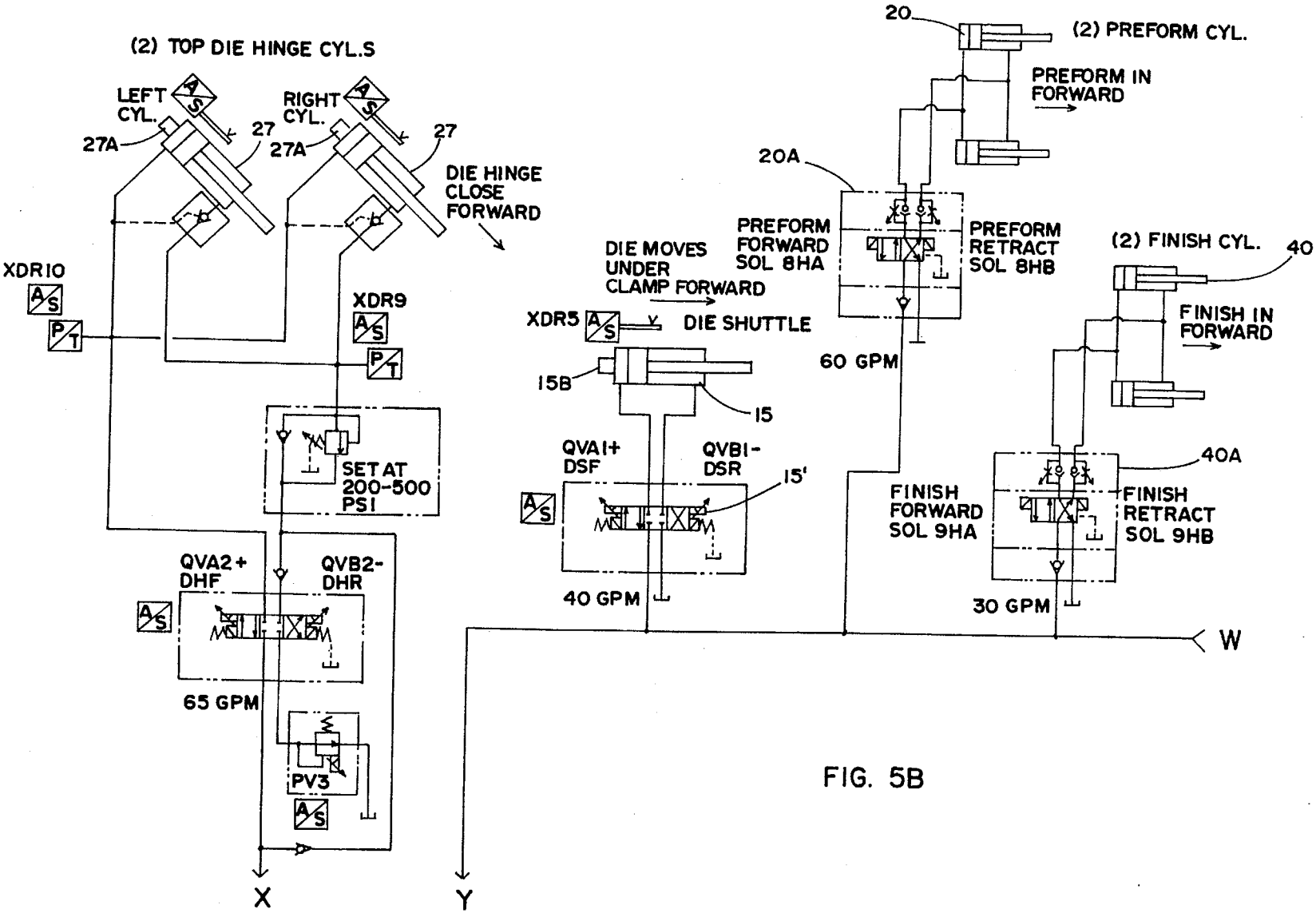
Figure 5C:
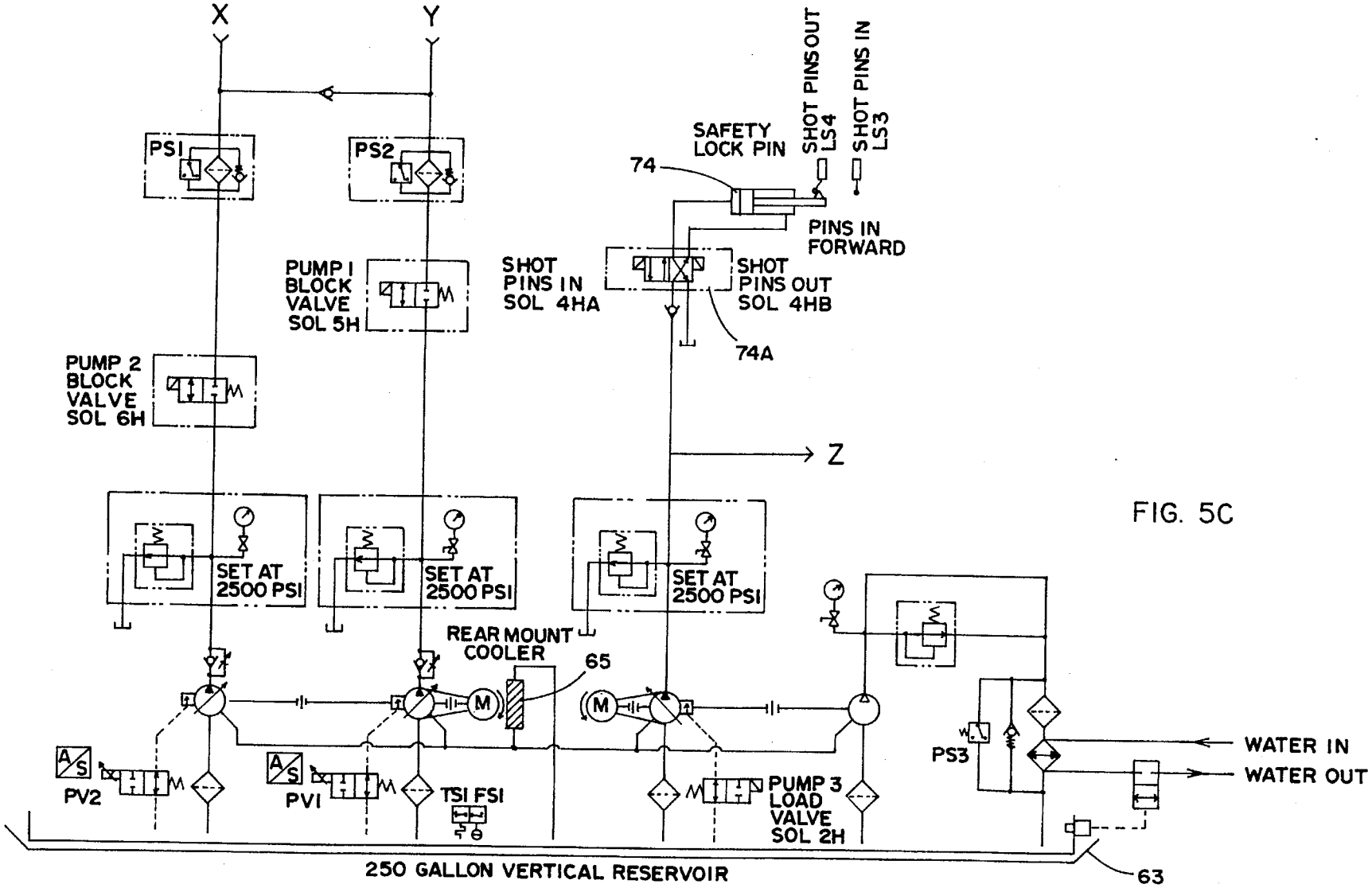
FIGS. 5C and 5D is a schematic view of the other part of the hydraulic system.
Figure 5D:
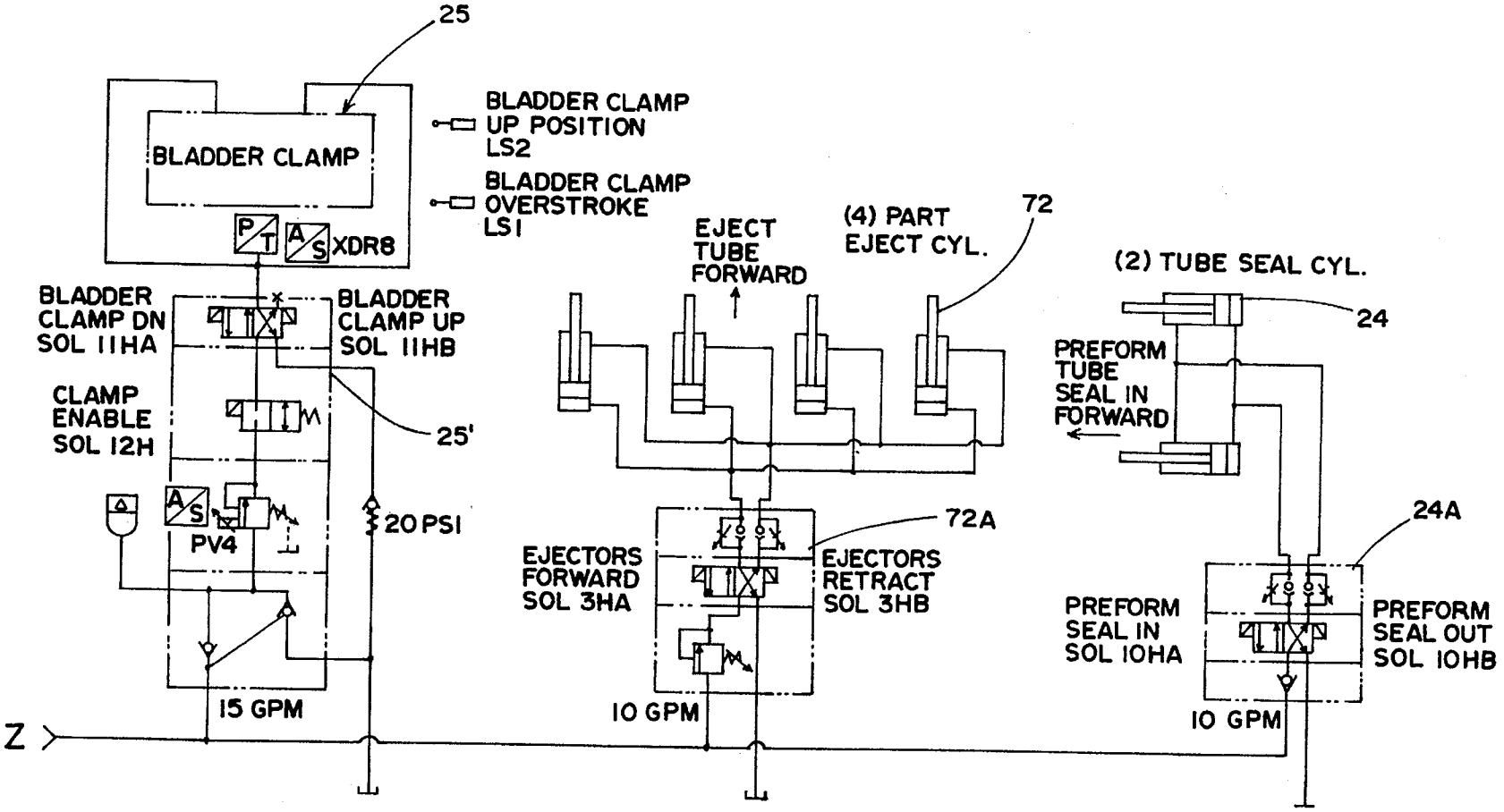

A hydraulic system 60 is depicted in FIGS. 5A and 5B. This system includes a suction reservoir 62, a recirculating pump 64, a tool bath tank 66, a large reservoir 63, a cooler 65, and other motors and pumps, all for storing and conveying hydroforming liquid, typically water, to various parts of the system. Downstream from pump 64 is a first single stage pressure intensifier 68 for a workpiece in the preform and semi-finish cavity 14, and a second pressure intensifier 70 for a workpiece in the finish cavity 16. A solenoid actuated valve 68A controls the output from intensifier 68 while a solenoid actuated valve 70A controls the output front intensifier 70. These valves 68A and 70A may be actuated in response to pressure sensors. Specifically, after the semi-finish hydroforming step and as the pressure in the workpiece in cavity 14 is decreasing, when this decreasing pressure hits a certain preset value, the solenoid valve 70A for intensifier 70 will actuate to allow intensified liquid pressure to be applied to the workpiece in cavity 16, such that there is a time overlapping of the hydroforming steps for the two workpieces. This saves considerable production time.

The end plugs 20 for the semi-finish cavity are also linked into the hydraulic system through solenoid valve 20A. The end plugs 40 for the finish cavity 16 are linked into the hydraulic system through solenoid valve 40A. The shuttle cylinder 15 is connected to the hydraulic system through solenoid valve 15'. This cylinder 15 is preferably of the known so-called "smart cylinder" type, including a pressure sensor 15B which detects any unplanned pressure increase of the cylinder due to an obstruction, e.g., the mold being partly open, to immediately stop the cylinder action to prevent damage to the equipment.

Cylinders 27 also are preferably of this "smart cylinder" type and include controllers 27A which allow bleeding off of hydraulic liquid from the cylinders, while keeping the cylinder pressure constant, when the mold assembly is being retracted into the clamp; and allowing liquid entry into the cylinders when the mold assembly is being transferred out of the clamp. These controls also stop the system in the event that some excessive pressure is encountered, e.g., by mold closing or something inadvertently left between the two mold elements.

As an alternative to cylinder 27 between the upper mold element 23 and frame 11, a pair of cylinders 127, depicted in phantom in FIG. 6C, can extend between the upper mold element 23 and the carriage or slide 13 on opposite sides of the mold. With this alternate arrangement, the cylinders 127 would not need the controlled release of fluid during advancement of the carriage between the platen as do cylinders 27. Thus, the programming control of the apparatus would be simpler.

The bladder clamp subassembly 25 is controlled through its valves 25'. The tube seal cylinders 24 are controlled by solenoid valve 24A. If part ejectors and their cylinders are employed as at 72 to lift workpieces from the cavities 14 and 16, then solenoid valve 72A is utilized to connect them with the hydraulic system and to control their operation. Optionally, safety lock pins can also be employed as shown at 74, to lock the mold assembly open, these being controlled by solenoid valve 74A.

The remaining components of the hydraulic system are considered self-explanatory and not described in detail.

The initial workpiece to be hydroform-expanded comprises an inner, metal, preferably steel, and most preferably stainless steel, tube or tubular element 50, and an outer tubular element 52, also of metal, and preferably steel, most preferably stainless steel. The inner diameter of outer tube element 52 basically coincides with the outer diameter of inner tube element 50 such that normally the initial workpiece has 360° contact between the two elements along the length thereof. The inner element has at least one opening 54 extending through its wall thickness from the inner cavity 56 defined by the inner element to the inner wall of the outer element. The one or more openings, and preferably two, along the length of the inner element are located only adjacent one end or both ends, preferably both ends, of the inner element, spaced from the open ends of the element an amount to be inward of the tapered noses 22 when in the first cavity, and inwardly of tapered noses 42 when in the second cavity. The tube elements of the initial workpiece are typically cylindrical in configuration, not yet having the flared end portions depicted in the drawings. Conceivably, however, the ends could be previously flared prior to placement in the first hydroforming cavity, e.g., when the tubes are pulled or rammed together or when the double tube is bent to effect any desired nonlinear configuration or angles therein. Furthermore, some double wall conduits or conduit portions need not have any bend zones, such that the cavities would have straight centerlines. If the ends are previously flared, it is still desirable to have tapered noses on the end plug for the first cavity, to hold the tubes on center in the cavity and to seal the tube ends.

The opposite ends 16' of cavity 16 are outwardly tapered to match the configuration and angle of the tapered noses 42. Optionally, the opposite ends of cavity 14 may also have outwardly flared portions matching those of the tapered noses 22. However, it is not as necessary to have these tapered ends on cavity 14 as on cavity 16 since the interaction of the tapered noses 42 and the ends 16' of cavity 16 must function to seal between the two tube elements 50 and 52 of the workpiece at the flared ends, as described hereinafter, during the second hydroforming stage of the process.

The purpose of the two-stage hydroforming operation is to first expand or enlarge both the inner and outer tube elements simultaneously by hydroforming in first cavity 14, and thereby obtain a predetermined final inner tube dimension, and then subsequently to expand or enlarge by hydroforming only the outer element further, while not changing the size of the inner element, using the second cavity 16. This workpiece is at least mostly of smaller outside diameter than the diameter of cavity 14 and is laid in the lower part of the cavity 14, and the top mold member is brought down to interfit with the lower mold member. During this closing, portions of the workpiece can be partially mechanically formed by the walls of cavity 14 acting as a die, as noted previously. The mold assembly is then shifted into the hydroforming station beneath crown 11C. Tremendous force is then applied by diaphragms 33 to hold the mold assembly totally closed and immovable during the hydroforming operation. Next, fluid actuators 25 are shifted axially to extend the first end plug subassemblies 20 into the workpiece W in cavity 14. Specifically, the tapered nose elements 42 are forced toward cavity 14, thereby engaging the cylindrical ends of workpiece W and flaring them outwardly as the tapered noses extend to their final position partially within cavity 14. This flaring also enables the workpiece to be held on center in this cavity and also in the subsequent cavity 16. When actuator 25 inserts nose 22, it also inserts seal 28 into cavity 14 and the workpiece therein a predetermined distance, past the openings 54 of inner tube 50. The second power actuators 24 are then actuated to axially extend collar 34 a small amount, thereby axially compressing the resilient annular seals 28. This causes them to radially expand into tight engagement with the ends of the inner peripheral wall of inner tube element 50, as well as rod 30, to tightly seal the ends of the inner workpiece cavity 56 axially inwardly of openings 54. Hydroforming liquid is then injected through liquid conduit 26 in at least one of the end plug subassemblies to fill space 56.

As noted, the hydroforming process is preferably performed in a bath of liquid, e.g., water, so as to be submerged. In such a situation, filling of the workpiece will occur with submersion of the workpiece so that only a small amount of added liquid under pressure through passage 26 will be necessary for hydroforming. Sufficient hydroforming pressure is then built up in the liquid inside the workpiece over a period of several seconds to a high value to simultaneously expand both the inner and outer tubular elements 50 and 52 until the outer element outer surface takes the configuration and size of cavity 14, and to give the inner element its desired final dimension. At this first forming stage, any flaws, e.g., in the weld of the longitudinal seam of inner element 50, can be detected since the pressurized liquid inside cavity 56 will tend to flow through any flaw in inner element 50 to be between tube elements 50 and 52 and thus cause a profile pressure curve to be generated in a different pattern because of the reduced resistance to forming with just the outer metal. If both inner and outer tubes failed, pressure would drop noticeably or cease to build. This first step thus acts as an excellent quality check, even on the inner element. As the pressure is then decreased over the next couple of seconds in the workpiece in this first cavity 14, it is increased over those same seconds in the workpiece in the second cavity 16. Thus, there is an overlap of the time which shortens the total time necessary. Initiation of the second cavity increase is controlled in response to pressure sensors on the first hydroforming system. When the pressure becomes totally released in the first cavity workpiece, seals 28 are caused to radially retract by retracting collar 34 axially, and the end plugs with tapered noses 22 and seals are retracted from the modified workpiece W' and cavity 14. There is no need to drain the workpiece when it is transferred over to second cavity 16.

Inasmuch as the size, i.e., diameter, of the second cavity is greater than that of the first cavity, there will be a gap between the outer wall of the partially expanded workpiece W' therein and the peripheral wall of the second cavity. The end plug subassemblies 40, when axially extended, cause the second pair of tapered noses 42 to engage the flared end portions of the workpiece to thereby center it in cavity 16. The tapered noses 42 of the second pair of end plug subassemblies 40 are inserted into cavity 16 and the partially expanded workpiece W' with sufficient force to press the flared ends of inner and outer elements 50 and 52 tightly together to create a seal between them. This is to prevent hydroforming liquid from escaping between the two tube elements during the second hydroforming operation. In this stage, openings 54 are now exposed to the entire inner cavity 56 of the workpiece. It will be realized that these steps will have been performed generally prior to or during hydroforming pressure increase on the workpiece in the first cavity 14 so that the workpiece in cavity 16 is ready to be pressurized. When hydroforming pressure is applied in the workpiece in cavity 16, the liquid through openings 54 will cause the pressure on both the inner wall and the outer wall of inner element 50 to be equal, but a significant outward force to be applied to the inside wall of outer element 52, causing it to expand to the finish dimensions of cavity 16, giving the outer element its desired dimensions and controlled accurate spacing from the inner element. After this is performed, the pressure is controllably decreased and released from the finished workpiece in cavity 16. Pressure is then released from diaphragm 33 to allow retainer 25B to retract upwardly a fraction of an inch to release the mold assembly. Cylinder 15 then transfers the mold assembly forwardly via carriage 13 on bed 11D out from beneath crown 11C anti diaphragm assembly 25. Cylinders 27 then retract to lift upper platen I9 and mold 23 to open the mold on hinge 17A. The finished workpiece in the form of an air gap dual wall conduit C is removed manually from the mold, workpiece W' is transferred from cavity 14 to cavity 16, a raw workpiece W is placed in cavity 14, and the process is ready to be repeated. As noted previously, ejection pins may be used to lift the workpieces partially up from the cavities for easier removal. The hydroforming liquid is subsequently drained out of the finished workpiece, to empty the workpiece of liquid. The entire hydroforming operation requires only a fraction of a minute so that production rates can be significantly high. Optionally, the offal at the ends of the workpiece, i.e., the flared end portions, can ultimately be severed to leave the finished conduit product. Each workpiece and each mold cavity can also be configured to form a multiple, e.g., two or more, of the desired final product, so that by cutting the finished product into two like pieces, production can be even further increased.

Those skilled in this art will likely conceive of various other changes in the process or apparatus, to accommodate a particular type of material, configuration or product use, within the scope of the inventive concept set forth herein. One such variation would be to not flare the ends of the workpiece as preferred and taught, but to otherwise form the seal at both ends. It is not intended that the invention should be limited to the preferred embodiment set forth herein as an example, but only by the scope of the appended claims and the reasonably equivalent apparatus and methods to those defined herein.

The embodiments of the invention in which an exclusive property or privilege is claimed are defined as follows:

1. A method of forming an air gap dual wall conduit from a dual wall tubular workpiece blank having an inner tube and an outer tube, comprising the steps of:

providing a mold assembly having a lower platen and an upper platen, a semi-finish mold cavity and a finish mold cavity between said platens;

providing first and second pairs of fluid supply and pressure creating hydroflow elements astraddle the ends of the respective ones of said cavities;

removing a dual wall semi-finished workpiece tube from said semi-finish mold cavity and inserting it into said finish mold cavity;

inserting a dual wall tubular workpiece into said semi-finish mold cavity;

closing said mold assembly;

placing said closed mold assembly under a pressure diaphragm;

applying fluid pressure to said diaphragm and thereby creating a holding force on said mold assembly;

pressurizing fluid within the inner tube of said dual wall blank workpiece to enlarge both tubes in said semi-finish cavity to the outline of said semi-finish cavity and thereby produce a semi-finished workpiece;

decreasing fluid pressure from said workpiece in said semi-finish cavity while simultaneously increasing fluid pressure within the outer tube of said semi-finished workpiece in said finish cavity and equalizing pressure across said inner tube to enlarge only said outer tube in said finish cavity and thereby produce a finished workpiece;

decreasing the fluid pressure from said finished workpiece in said finish cavity; and opening said mold assembly.

2. The method in claim 1 including the step of mechanically preforming said blank workpiece while closing said mold assembly.

3. The method in claim 1 wherein said mold closing is forcefully performed under pressure to mechanically preform said workpiece in said semi-finish cavity.

4. The method in claim 1 wherein said step of increasing fluid pressure within the outer tube of said semi-finished workpiece is initiated after the pressure in the workpiece in said semi-finish cavity has decreased to a predetermined value.

5. A method of forming an air gap dual wall conduit from a dual wall tubular workpiece blank having an inner tube and an outer tube, comprising the steps of:

providing a mold assembly having a lower platen and an upper platen, a semi-finish mold cavity and a finish mold cavity between said platens;

providing first and second pairs of fluid supply and pressure creating hydroflow elements astraddle the ends of the respective ones of said cavities;

removing a dual wall semi-finished workpiece tube from said semi-finish mold cavity and inserting it into said finish mold cavity;

inserting a dual wall tubular workpiece into said semi-finish mold cavity;

closing said mold assembly under pressure to mechanically preform said workpiece in preselected areas;

placing said closed mold assembly under the holding force of a pressure diaphragm and pressurizing fluid within the inner tube of said dual wall blank workpiece to enlarge both tubes in said semi-finish cavity to the outline of said semi-finish cavity and thereby produce a semi-finished workpiece;

decreasing fluid pressure from said workpiece in said semi-finish cavity and increasing fluid pressure within the outer tube of said semi-finished workpiece in said finish cavity while equalizing pressure across said inner tube, to enlarge only said outer tube in said finish cavity and thereby produce a finished workpiece;

decreasing the fluid pressure from said finished workpiece in said finish cavity; and opening said mold assembly.

6. A method of forming an air gap dual wall conduit from a dual wall tubular workpiece blank having an inner tube and an outer tube, comprising the steps of:

providing a mold assembly having a lower platen and an upper platen, a semi-finish mold cavity and a finish mold cavity between said platens;

providing first and second pairs of fluid supply and pressure creating hydroflow elements astraddle the ends of the respective ones of said cavities;

removing a dual wall semi-finished workpiece from said semi-finish mold cavity and inserting it into said finish mold cavity;

inserting a dual wall tubular workpiece blank into said semi-finish mold cavity;

closing said mold assembly;

pressuring fluid within the inner tube of said dual wall workpiece blank to enlarge both tubes in said semi-finish cavity to the outline of said semi-finish cavity and thereby produce a semifinished workpiece;

decreasing fluid pressure from said workpiece in said semi-finish cavity while simultaneously increasing fluid pressure within the outer tube of said semi-finished workpiece in said finish cavity and equalizing pressure across said inner tube to enlarge only said outer tube in said finish cavity and thereby produce a finished workpiece;

decreasing the fluid pressure from said finished workpiece in said finish cavity; and opening said mold assembly.

7. The method in claim 6 including the step of mechanically preforming said blank workpiece while closing said mold assembly.

8. The method in claim 6 wherein said mold closing is forcefully performed under pressure to mechanically preform said workpiece in said semi-finish cavity.

9. The method of claim 6 wherein said step of increasing fluid pressure within the outer tube of said semi-finished workpiece is initiated after the pressure in the workpiece in said semi-finish cavity has deceased to a predetermined value.

10. A method of forming an air gap dual wall conduit from a dual wall tubular workpiece blank having an inner tube and an outer tube, comprising the steps of:

providing a mold assembly having a lower platen and an upper platen, a semi-finish mold cavity and a finish mold cavity between said platens;

providing first and second pairs of fluid supply and pressure creating hydroflow elements astraddle the ends of the respective ones of said cavities;

removing a dual wall semi-finished workpiece from said semi-finish mold cavity and inserting it into said finish mold cavity;

inserting a dual wall tubular workpiece blank into said semi-finish mold cavity;

closing said mold assembly under pressure to mechanically preform said workpiece in preselected areas;

placing said closed mold assembly under a holding force and pressurizing fluid within the inner tube of said dual wall workpiece blank to enlarge both tubes in said semi-finish cavity to the outline of said semi-finish cavity and thereby produce a semi-finished workpiece;

decreasing fluid pressure from said workpiece in said semi-finish cavity and increasing fluid pressure within the outer tube of said semi-finished workpiece in said finish cavity while equalizing pressure across said inner tube, to enlarge only said outer tube in said finish cavity and thereby produce a finished workpiece.

* * * * *

UNITED STATES PATENT AND TRADEMARK OFFICE

CERTIFICATE OF CORRECTION

PATENT NO. : 5,582,052
DATED : December 10, 1996
INVENTOR : Donald R. Rigsby

It is certified that error appears in the above-identified patent and that said Letters Patent is hereby corrected as shown below:

Column 1, line 39;

"tipper" should be --upper--.

Column 3, line 4;

"stirface" should be --surface--.

Column 3, line 5;

"Turkitc™" should be --Turkite™--.

Column 3, line 27;

"tipper" should be --upper--.

Column 4, line 3;

"tipper" should be --upper--.

UNITED STATES PATENT AND TRADEMARK OFFICE

CERTIFICATE OF CORRECTION

PATENT NO. : 5,582,052
DATED : December 10, 1996
INVENTOR : Donald R. Rigsby

It is certified that error appears in the above-identified patent and that said Letters Patent is hereby corrected as shown below:

Column 5, line 25;

"toolet" should be --mold--.

Column 6, line 41;

"front" should be --from--.

Column 9, line 38;

"anti" should be --and--.

Signed and Sealed this

Sixth Day of May, 1997

Bruce Lehman

*Attest:*

BRUCE LEHMAN

*Attesting Officer*

*Commissioner of Patents and Trademarks*